United States Patent [19]

Younes

[11] Patent Number: 4,925,159

[45] Date of Patent: May 15, 1990

[54] VERTICAL POWER PULLING DEVICE

[76] Inventor: Joseph F. Younes, 129 Brunswick Ave., Gardiner, Me. 04345

[21] Appl. No.: 326,920

[22] Filed: Mar. 22, 1989

[51] Int. Cl.[5] ..... E21B 9/00

[52] U.S. Cl. ..... 254/30

[58] Field of Search ..... 254/29 R, 30, 31, 105, 254/106, 132; 166/77

[56] References Cited

U.S. PATENT DOCUMENTS 1,398,822 11/1921 Wilson ..... 254/31

4,371,018 2/1983 Arnold ..... 254/30

*Primary Examiner*—Robert C. Watson

*Attorney, Agent, or Firm*—Fish & Richardson

[57] ABSTRACT

A pulling device for use in withdrawing well points and the like comprises a boom, a column fixedly mounted at an outer end of the boom, apparatus for adjustable positioning of the column over a well point to be withdrawn from the ground and disposing it vertically for pulling without jamming. A gripping carriage is vertically moveable on the column. The carriage carries a first, fixed jaw in alignment with the center plane of the column comprising first and second vertically spaced apart first jaw elements and a second jaw comprising first and second vertically spaced apart second jaw elements. The second jaws are moveable relative to the first jaws so as to grasp the top of the well point to be pulled between them. Hydraulic cylinders power the jaws and raise the carriage so as to pull the gripped point.

8 Claims, 5 Drawing Sheets

VERTICAL POWER PULLING DEVICE

The invention relates to power pulling devices for vertical withdrawal of well points, posts and the like.

Well points, or well pipes, are driven into the ground, e.g. for depths up to about 25 feet, where the water table is close to the surface. Groundwater enters the pipe, entering through perforations along its length, and is removed by means of a pump. One or a few well points may be used for supplying water for consumption in suitable locations, but the invention is more particularly addressed to well points employed in numbers, e.g., about construction sites, along the paths of underground sewer lines, concrete channels, designated building lots, excavation for laying concrete or pipelines or anywhere it is desired to remove groundwater for temporarily lowering the water table to permit excavation and installation of pipes or equipment.

When the need has ended, e.g. upon completion of a project, the well points are removed from the ground for use at the next site. In order to avoid jamming of the pipes in the ground, it is important that the pulling force be applied vertically. Also, it is advantageous to be able to pull more than one point without having to move the entire pulling apparatus each time to another location.

SUMMARY OF THE INVENTION

In accordance with the invention there is provided a pulling device for use in withdrawing well points and the like comprising a boom, a column fixedly mounted at an outer end of the boom, means for adjustable positioning of the column adjacent a well point to be withdrawn from the ground, means for disposing the column vertically during a well point pulling operation, and a gripping carriage mounted for vertical movement along said column. The carriage comprises a base plate having a face surface; mounted upon the face surface of this base plate and spaced from the plane of the base plate surface, are (A) a first, fixed jaw in alignment with the center plane of the column comprising first and second vertically spaced apart first jaw elements, each first jaw element defining an arcuate, well point-engaging surface and (B) a second jaw comprising first and second vertically spaced apart second jaw elements, each of the second jaw elements defining an arcuate well point-engaging surface. Means are mounted upon the face surface of the base plate for movement of the second jaw relative to the first jaw along the face surface of the base plate for disposing the arcuate surfaces of the first and second jaw elements in gripping engagement about a well point to be removed. The means for movement of the second jaw comprises a sleeve fixedly mounted upon the face surface of the base plate, a beam disposed for axial movement within the sleeve, the second jaw being fixedly joined to the beam, and power means connected to the second jaw for axially moving the beam and attached second jaw relative to the first fixed jaw. Powered means are provided for moving the carriage vertically along the column so as to pull the gripped point vertically upwardly out of the ground.

In preferred embodiments, the column defines a track, and the carriage further comprises bearing means disposed for engagement with the track for vertical movement therealong; the carriage further comprises base plate elements for fixedly disposing the first fixed jaw and the second moveable jaw in a plane spaced from and generally parallel to the plane of the face surface of the base plate; at least two ground-engaging base members are attached to the column, each said base member adapted to be positioned independently of other base members to engage underlying terrain in a manner to stabilize and maintain the vertical orientation of the column during a pulling operation; each base member further comprises power means for extending the base member to engage underlying terrain; the power means for moving the carriage vertically along the column comprises an hydraulic cylinder connected to the carriage or, alternatively, a pulley mounted upon the column and a cable disposed to extend about the pulley thereby to connect the cylinder in actuating relation to the carriage; and the means for adjustable location of the column comprises a stub boom pivotally connected at an inner end thereof and power means for adjusting its angular position.

Thus there is provided a device for removing well points or the like with a force applied vertically in a manner to avoid jamming. The device furthermore is suited for use on uneven ground or under other difficult conditions of terrain typical about a construction site, and may be used for removal of multiple well points with a single set up.

These and other features and advantages will become apparent from the following description of a presently preferred embodiment taken in conjunction with the accompanying drawings, and from the claims.

PREFERRED EMBODIMENTS

Figure 1:
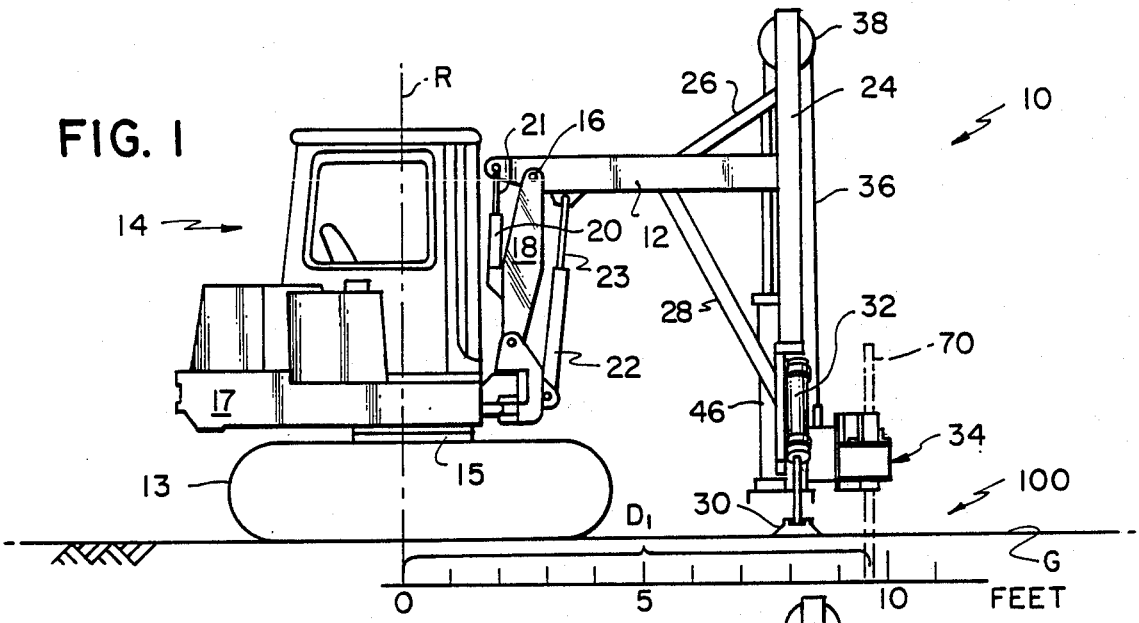
FIGS. 1 and 2 are side views of a tractor unit equipped with a preferred embodiment of the pulling device of the invention.
Figure 2:
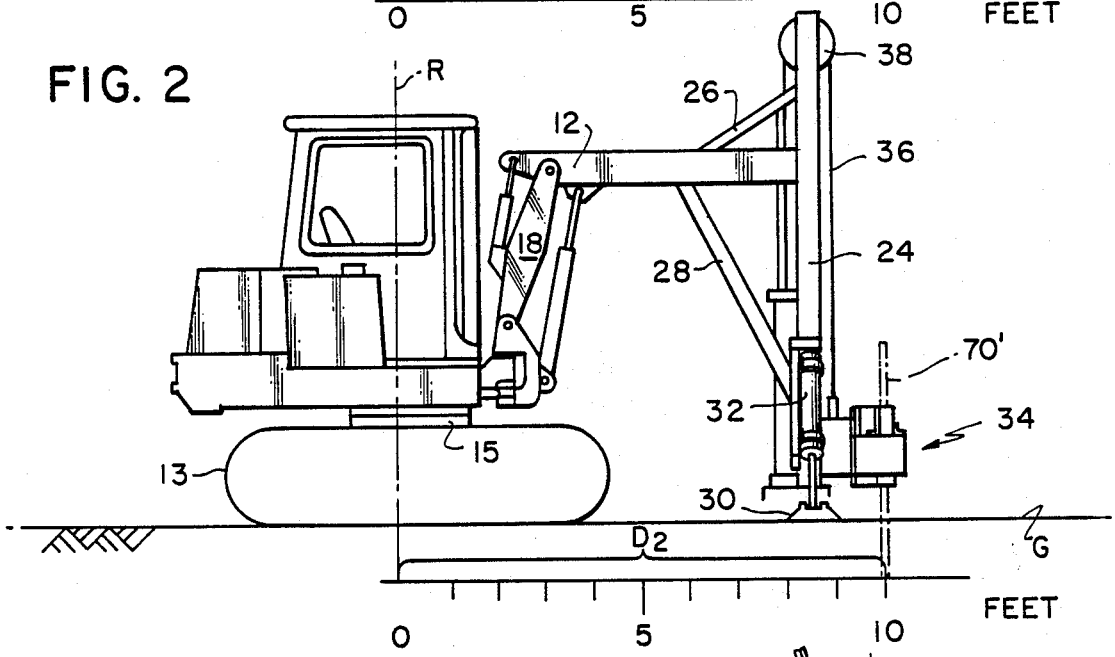
Figure 3:
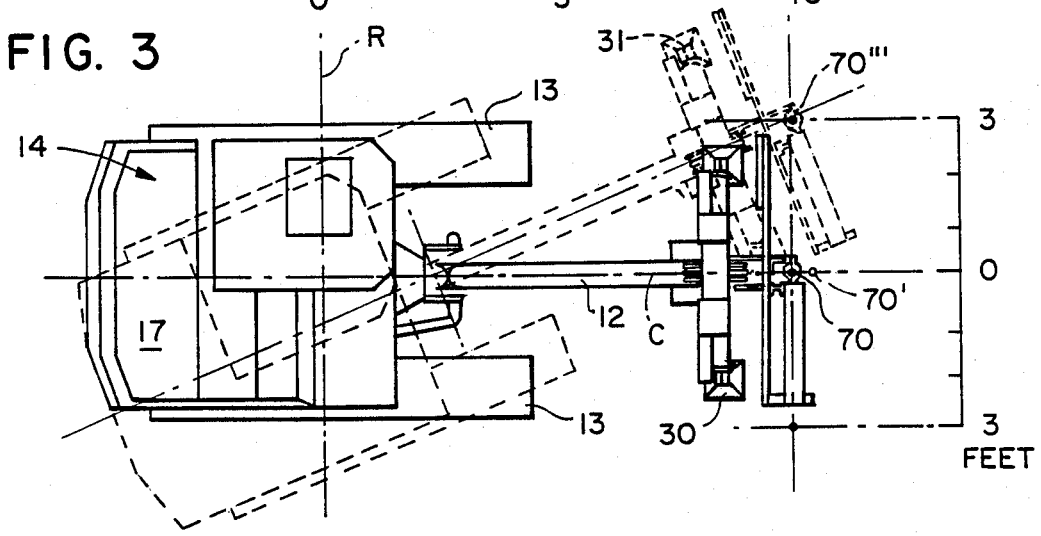
FIG. 3 is a plan view of the tractor unit of FIGS. 1 and 2.

Referring to FIGS. 1, 2 and 3, the power pulling device 10 of the invention is mounted on boom 12 of a commercially available tractor unit 14, e.g. a John Deere 50 Excavator manufactured by John Deere & Co. of Moline, Ill. The tractor unit is equipped with tracks 13, and is mounted for rotation on hydraulic slewing ring 15.

The boom 12 is mounted to pivot about pin 16 at the end of stub boom 18 by positioning of cylinder rods 21, 23 of hydraulic cylinders 20, 22 attached to boom 12 which are operated to maintain the boom horizontal during the well point pulling operation, as described below. Column 24 is fixedly attached to the outer end of boom 12 and is held perpendicular thereto with the assistance of brace arms 26, 28. Outriggers 30, 31, mounted on hydraulic cylinders 32, 33 at either side of the base of column 24 are engaged with the ground surface during the well point pulling operation to further maintain the vertical position of the column.

Figure 4:
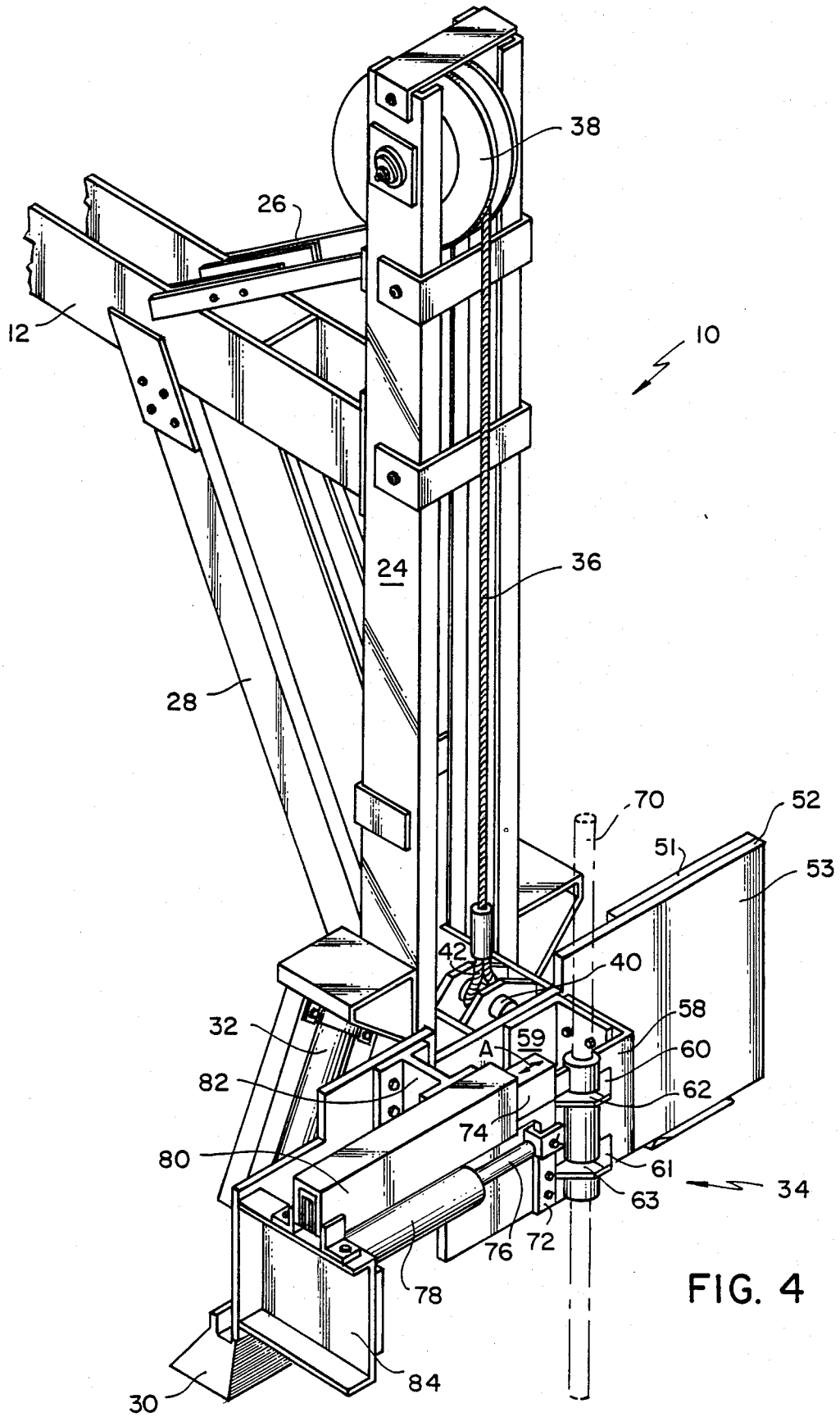
FIG. 4 is a perspective view of the outer end portion of the pulling device of the invention.
Figure 4A:
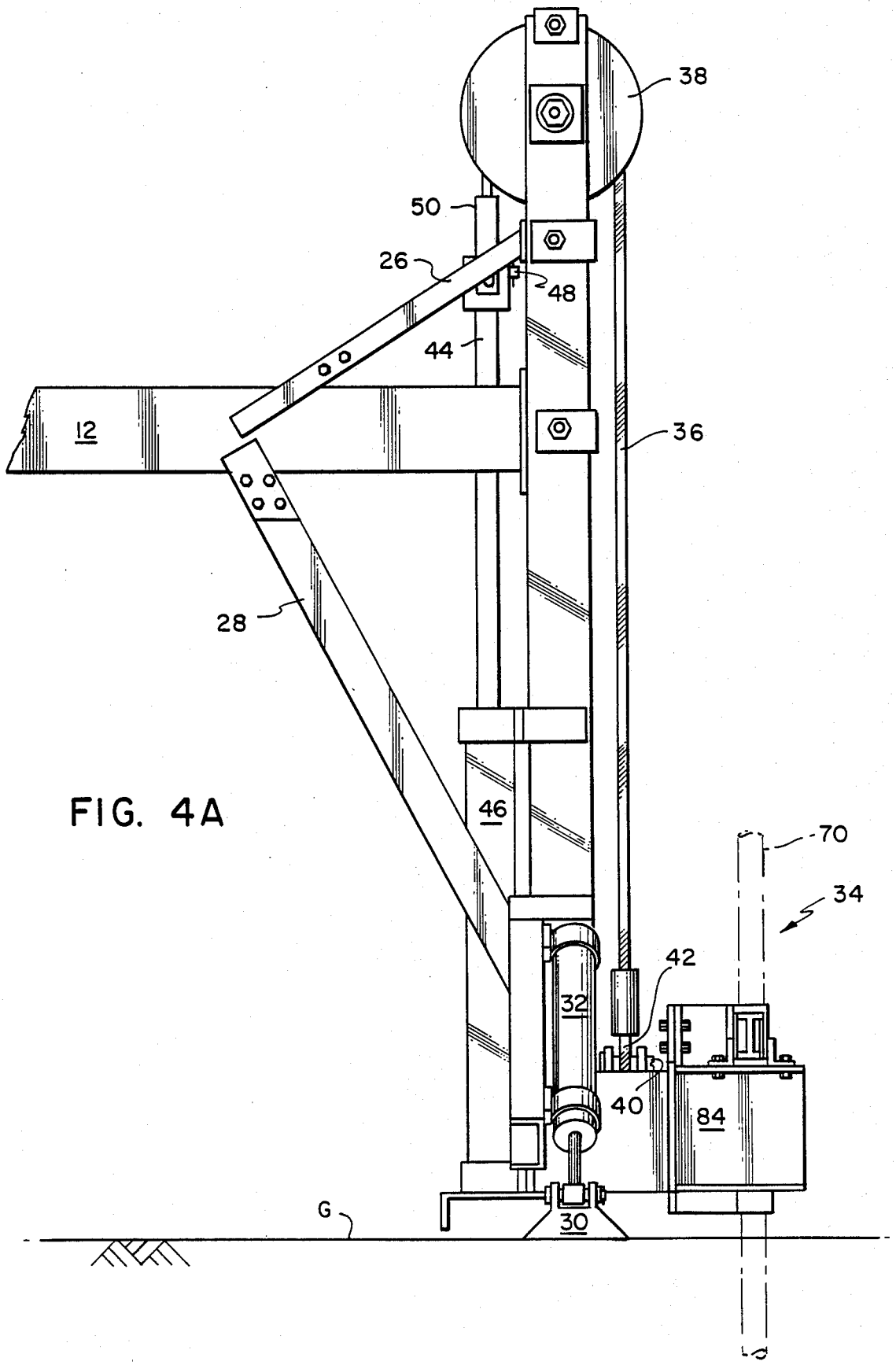
FIGS. 4A and 4B are side and front views of the end portion of the device of FIG. 4.

Referring also to FIG. 4, the well point gripping carriage 34 is mounted to be moved vertically along column 24 by means of steel cable 36 extending over heavy duty pulley 38 mounted at the top of the column. The cable is attached to carriage 34 by pin 40 extending through cable eye 42. The other end of cable 36 (FIG. 4A) is attached to cylinder rod 44 of cylinder 46 by pin 48 extending through cable termination eye 50.

Figure 4B:
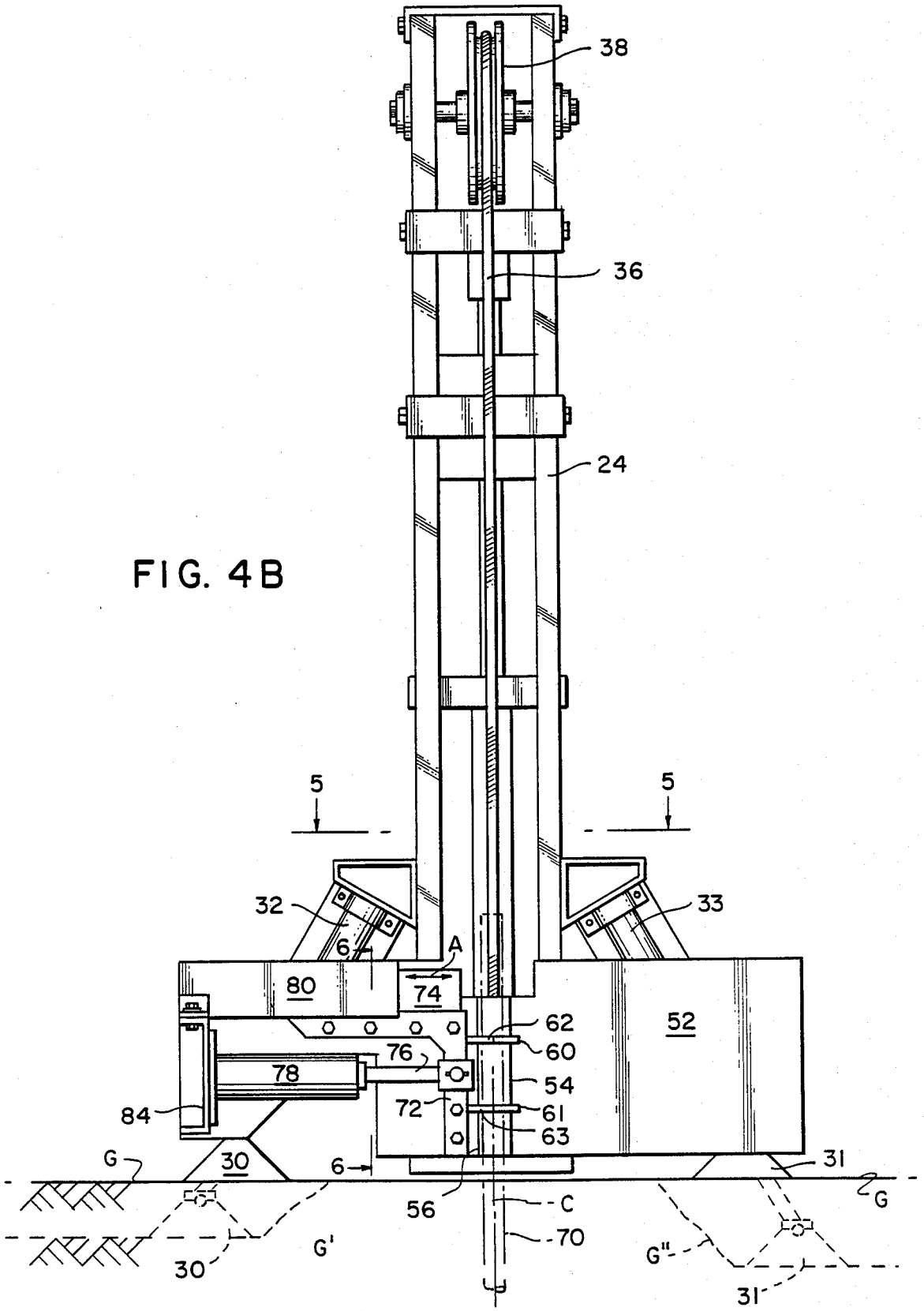
Figure 5:
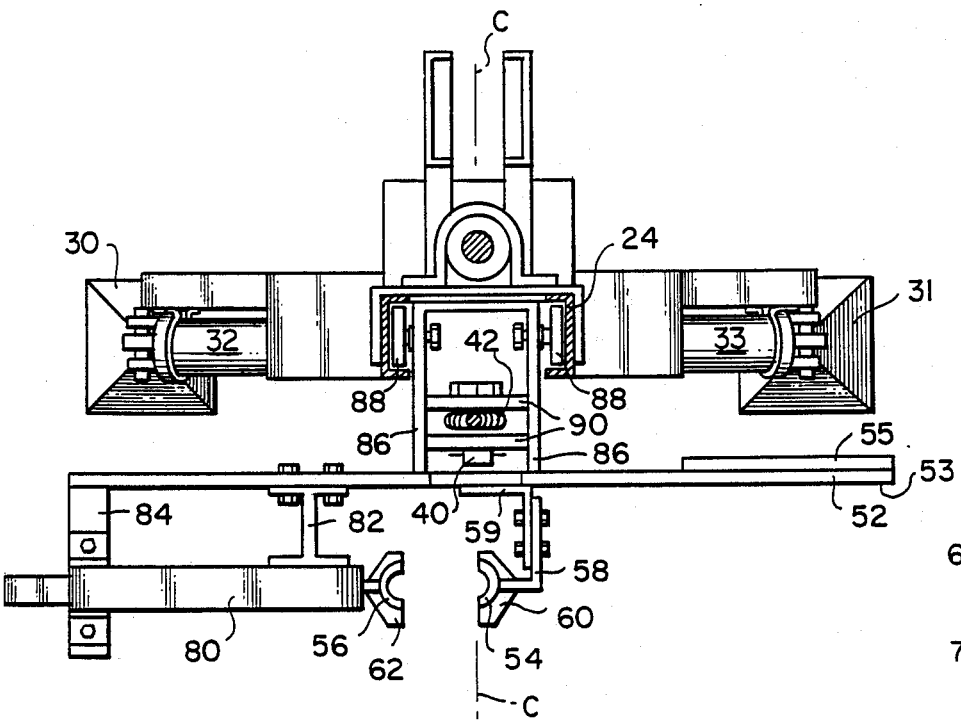
FIG. 5 top section of view taken on the line 5—5 of FIG. 4B.
Figure 6:
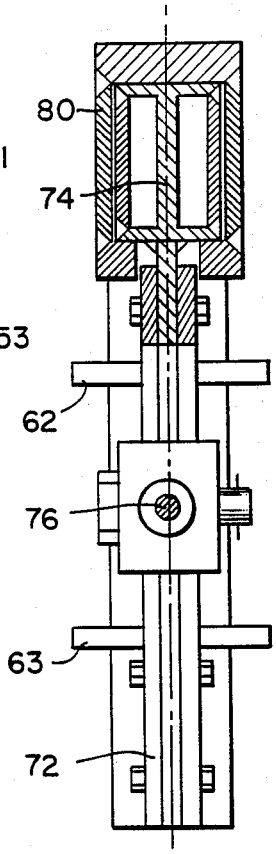
FIG. 6 is a side sectional view taken on the line 6—6 of FIG. 4B.
Figure 7:
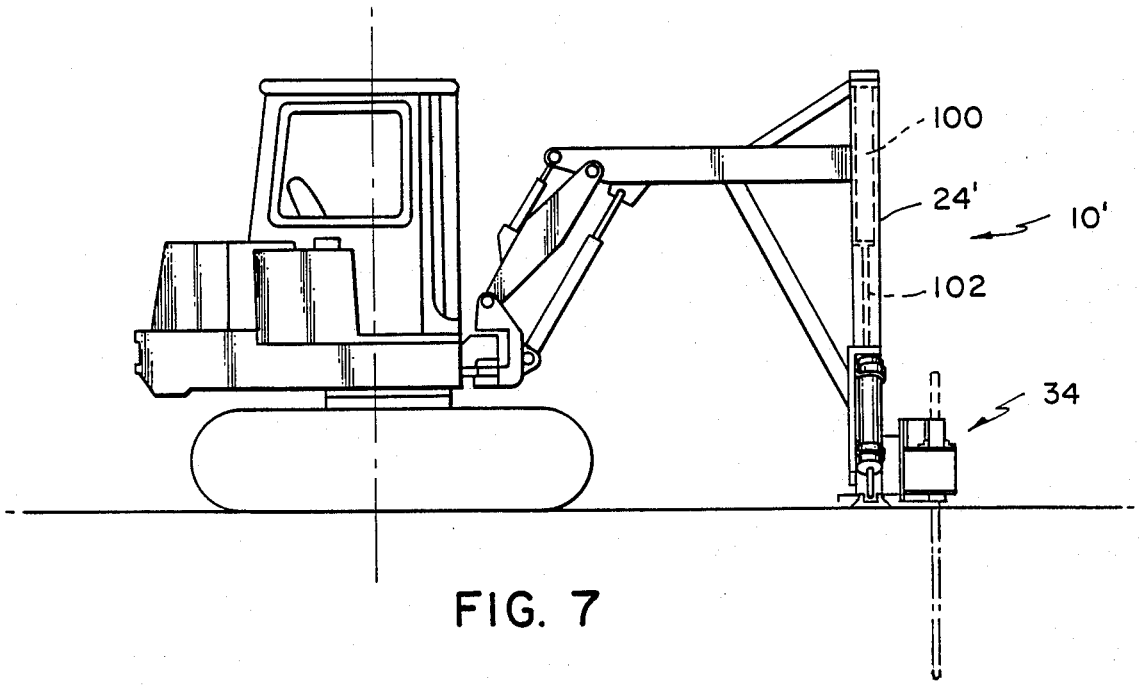
FIG. 7 is a side view of a tractor unit equipped with an alternate embodiment of a pulling device of the invention.

Referring now also to FIG. 4B, the pulling carriage 34 includes a base plate 52 having a face surface 53 to which are mounted, at a fixed spacing from the plane of surface 53, a fixed jaw 54 and a moveable jaw 56. Fixed jaw 54 is formed of a pair of steel angle bars 58, 59 (FIG. 5) fixedly joined together, e.g. by welding or bolts, with vertically spaced plates or jaw elements 60, 61 mounted at their outer end. Moveable jaw 56 also includes a pair of vertically spaced steel plates or jaw elements 62, 63 mounted to engage plates 60, 61 of the fixed jaw, the pairs of plates 60, 62 and 61, 63 defining arcuate surfaces disposed to grip about a well point 70, the opposed elements of each pair of jaws disposed to grip the well point at the center plane C of the carriage. The moveable jaw is mounted on plate 72 which in turn is attached to steel beam 74 and to cylinder rod 76 of hydraulic cylinder 78. Beam 74 is disposed for axial movement (arrow A) within sleeve 80. The sleeve is fixedly attached to the base plate 52 by means of I-beam 82 and channel iron 84 to which cylinder 78 is also mounted. Plate 55, attached at the rear of plate 52, serves to balance the weight of carriage 34 about center line C.

The base plate 52 is fixedly joined, e.g. by welding, to plates 86 extending within column 24. The column defines a pair of opposed tracks within which are disposed bearings 88 mounted to plates 86 for smooth lifting operation. As described above, the carriage is attached to cable 36 by pin 40 extending through cable termination 42 and plates 90, disposed between plates 86.

In order to remove multiple well points about, e.g., a construction site 100, in a manner that is efficient, i.e., more than one well point pulled for each set-up of equipment, and also that results in the well points being pulled vertically without bending or jamming, a tractor 14 bearing the vertical power pulling apparatus 10 of the invention is manuevered close to the site of several well points 70, 70′, 70″, 70‴ (FIGS. 1–3).

The position of column 24, held vertical, is adjusted by rotation of the tractor body 17 on slewing ring 15 and by operation of hydraulic cylinders 20, 22 so that the carriage is positioned with fixed jaw 54 in engagement with well point 70. For example, as seen by comparison of FIG. 1 with FIG. 2, the distance D1 to well point 70 (FIG. 1) from the center of rotation (R) of the tractor is less than the distance D2 to the well point 70′ (FIG. 2). By adjustment of cylinders 20, 22, the position of carriage 34 relative to the tractor is adjusted, while maintaining the vertical orientation of column 24.

Cylinders 32, 33 are actuated to extend outriggers 30, 31 to engage the surface G of the ground to support the vertical orientation of column 24. (As seen in FIG. 4B, separate operation of the outriggers allows the pulling device to compensate for uneven ground surfaces where the surfaces G′, G″ beneath one or both outriggers is not level with the tractor treads.)

Cylinder 78 is actuated to extend cylinder rod 76, and beam 74 moves axially, extending from sleeve 80 and moving moveable jaw 56 into gripping engagement with fixed jaw 54 about the well point.

Cylinder 46 is next actuated to apply pulling force to draw cable 36 about pulley 38, thereby lifting the carriage 34 to draw the well point from the ground. Due to the vertical orientation of the column 24, the carriage mounted to ride therealong moves vertically to draw the well point without bending or jamming. At the end of each stroke of cylinder 46, if the well point is not fully withdrawn from the ground, the moveable jaw 56 is retracted to disengage from the well point and travel of cylinder 46 is reversed to lower the carriage. The jaws are then reengaged to grip about the well point and the steps are repeated.

After a first well point, e.g. well point 70, is removed, the position of carriage 34 of the vertical pulling device 10 of the invention is simply adjusted for removal of other well points in the region (e.g., well points 70′, 70″, 70‴; FIG. 3), without the usual time consuming task of repositioning the tractor. Instead, according to the invention, after the outriggers 30, 31 are retracted, the carriage is moved to a new position (shown in dashed lines, FIG. 3) adjacent another well point (70‴) to be withdrawn, by rotation of the tractor body upon slewing ring and adjustment of cylinders 20, 22. The fixed jaw is positioned adjacent the new well point, the outriggers 30, 31 extended, and the jaws 54, 56 engaged to grip about the new well point. Removal of the second or additional well points then proceeds as described above.

While there have been herein disclosed and described presently preferred embodiments of the invention, it will nevertheless be understood that it is not intended that the scope of the invention be limited thereto but should be limited only by the proper scope to be afforded the appended claims.

For example, referring to FIG. 8, in another embodiment a well point pulling device 10′ of the invention may include, instead of the pulley and cable arrangement as described above, a cylinder 100 mounted to column 24′, the cylinder rod 102 of hydraulic cylinder 100 being attached directly to carriage 34.

What is claimed is:

1. A pulling device for use in withdrawing well points and the like comprising:

a boom;

a column fixedly mounted at an outer end of said boom;

means for adjustable positioning of said column adjacent a well point to be withdrawn from the ground;

means for disposing said column vertically during a well point pulling operation;

a gripping carriage mounted for vertical movement along said column;

said carriage comprising: a base plate having a face surface; mounted upon the face surface of said base plate in alignment with the center plane of said column, and spaced from the plane of the base plate surface, a first, fixed jaw comprising first and second vertically spaced apart first jaw elements, each said first jaw element defining an arcuate, well point-engaging surface; a second jaw mounted upon the face surface of said base plate, said second jaw comprising first and second vertically spaced apart second jaw elements, each said second jaw element defining an arcuate well point-engaging surface; and means mounted upon the face surface of said base plate for horizontal movement of said second jaw relative to said first jaw along the face surface of said base plate for disposing the arcuate surfaces of said first and second jaw elements in gripping engagement about a well point to be removed, said means for horizontal movement of said second jaw comprising a sleeve fixedly mounted upon the face surface of the base plate, a beam disposed for axial movement within said sleeve, said second jaw being fixedly joined to said beam, and power means connected to said second jaw for axially moving said beam and attached second jaw horizontally relative to said first fixed jaw; and powered means for moving said carriage vertically along said column.

2. The pulling device of claim 1 wherein said column defines a track and said carriage further comprises bearing means disposed for engagement with said track for vertical movement therealong.

3. The pulling device of claim 1 wherein said carriage further comprises base plate elements for fixedly disposing said first fixed jaw and said second moveable jaw in a plane spaced from and generally parallel to the plane of the face surface of said base plate.

4. The pulling device of claim 1 further comprising at least two ground-engaging base members attached to said column, each said base member adapted to be positioned independently of other base members to engage underlying terrain in a manner to stabilize and maintain the vertical orientation of said column during a pulling operation.

5. The pulling device of claim 4 wherein each said base member further comprises power means for extending said base member to engage underlying terrain.

6. The pulling device of claim 1 wherein said power means for moving said carriage vertically along said column comprises an hydraulic cylinder connected to said carriage.

7. The pulling device of claim 6 wherein said power means further comprises a pulley mounted upon said column, and a cable disposed to extend about said pulley thereby to connect said cylinder and said carriage.

8. The pulling device of claim 1 wherein said means for adjustable location of said column comprises a stub boom pivotally connected at an inner end of said boom and power means for adjusting the angular position of said stub boom.

* * * * *

UNITED STATES PATENT AND TRADEMARK OFFICE

CERTIFICATE OF CORRECTION

PATENT NO. : 4,925,159

DATED : May 15, 1990

INVENTOR(S) : Joseph F. Younes

It is certified that error appears in the above-identified patent and that said Letters Patent is hereby corrected as shown below:

On the title page under References Cited, the following should be added:

| | | | |
|---|---|---|---|
| 3,233,868 | 2/1966 | Harvey, et al. | 254/31 |
| 3,290,006 | 12/1966 | Dubberke | 254/31 |
| 3,525,502 | 9/1968 | Fisher | 254/30 |
| 3,647,185 | 3/1972 | Phibbs | 254/30 |
| 3,726,506 | 7/1971 | Vanderwaal, et al. | 254/29 |
| 3,946,988 | 3/1976 | Kehren | 254/30 |
| 4,067,369 | 1/1978 | Harmon | 144/34R |
| 4,256,286 | 3/1981 | Hudgins | 254/30 |

UNITED STATES PATENT AND TRADEMARK OFFICE

CERTIFICATE OF CORRECTION

PATENT NO. : 4,925,159

DATED : May 15, 1990

INVENTOR(S) : Joseph F. Younes

It is certified that error appears in the above-identified patent and that said Letters Patent is hereby corrected as shown below:

FOREIGN PATENT DOCUMENTS 2,319,728 10/1974 West Germany

OTHER PUBLICATIONS

John Deere Commercial Literature (50 Excavator)

Col. 2 line 41, after "5" insert -- is a --.

Signed and Sealed this

Eleventh Day of February, 1992

*Attest:*

HARRY F. MANBECK, JR.

*Attesting Officer*

*Commissioner of Patents and Trademarks*